US007243627B2

(12) United States Patent
Izumi et al.

(10) Patent No.: US 7,243,627 B2
(45) **Date of Patent: *Jul. 17, 2007**

(54) ENGINE ROTATION CONDITION DETECTING SYSTEM AND ENGINE CONTROL METHOD

(75) Inventors: Kazunari Izumi, Kariya (JP); Haruyuki Urushihata, Chiryu (JP)

(73) Assignee: DENSO Corporation, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/213,898

(22) Filed: Aug. 30, 2005

(65) Prior Publication Data

US 2006/0042578 A1 Mar. 2, 2006

(30) Foreign Application Priority Data

Aug. 31, 2004 (JP) ..... 2004-253175

(51) Int. Cl.
*F01L 1/34* (2006.01)

(52) U.S. Cl. ..... 123/90.17; 123/90.31

(58) Field of Classification Search ..... 123/90.15, 123/90.16, 90.17, 90.18, 90.27, 90.31, 90.6
See application file for complete search history.

(56) References Cited

U.S. PATENT DOCUMENTS

| | | | | |
|---|---|---|---|---|
| 5,417,187 | A | 5/1995 | Meyer et al. | |
| 5,680,837 | A | 10/1997 | Pierik | |
| 5,924,395 | A | 7/1999 | Moriya et al. | |
| 6,119,641 | A * | 9/2000 | Koch et al. | 123/90.17 |
| 6,129,061 | A * | 10/2000 | Okuda et al. | 123/90.17 |
| 6,328,006 | B1 | 12/2001 | Heer | |
| 6,405,694 | B2 | 6/2002 | Sato | |
| 6,412,459 | B1 | 7/2002 | Takahashi et al. | |
| 6,446,602 | B1 | 9/2002 | Yonezawa et al. | |
| 7,107,951 | B2 * | 9/2006 | Urushihata et al. | 123/90.17 |
| 2005/0211207 | A1 | 9/2005 | Urushihata | |
| 2006/0042579 | A1 | 3/2006 | Izumi et al. | |

FOREIGN PATENT DOCUMENTS

| | | |
|---|---|---|
| JP | 60-240875 | 11/1985 |
| JP | U-61-186708 | 11/1986 |

(Continued)

OTHER PUBLICATIONS

Examination Report cited in corresponding JP application JP2002-320612.

(Continued)

*Primary Examiner*—Ching Chang
(74) *Attorney, Agent, or Firm*—Nixon & Vanderhye P.C.

(57) ABSTRACT

An internal combustion engine has a variable valve timing apparatus including a driving motor between a crankshaft and a camshaft. The driving motor rotates synchronously with the camshaft when the valve timing apparatus is not in operation. A motor rotation sensor produces a motor rotation signal. When the engine rotation speed is below a reference speed, the driving motor is not energized. Under this condition, the rotation speed and the rotation direction of the engine are calculated based on the motor rotation signal in place of a crank rotation signal produced by a crank angle sensor. Further, the rotation stop position of the engine is calculated based on the motor rotation signal when the engine is stopped.

5 Claims, 4 Drawing Sheets

FOREIGN PATENT DOCUMENTS

| | | |
|---|---|---|
| JP | A-6-213021 | 8/1994 |
| JP | A-7-054620 | 2/1995 |
| JP | 8-109840 | 4/1996 |
| JP | 8-210158 | 8/1996 |
| JP | A-10-227236 | 8/1998 |
| JP | A-2001-207879 | 8/2001 |
| JP | A-2001-234765 | 8/2001 |
| JP | A-2001-248410 | 9/2001 |
| JP | A-2001-355462 | 12/2001 |
| JP | 2002-130037 | 5/2002 |
| JP | 2002-138865 | 5/2002 |
| JP | A-2002-161763 | 6/2002 |

OTHER PUBLICATIONS

Examination Report cited in corresponding JP application JP2003-045392.
U.S. Appl. No. 10/510,765 (corresponds to WO 2004/038200 A1, which is cited on p. 2 of the specification).
U.S. Appl. No. 11/213,900.
U.S. Appl. No. 11/494,612.

* cited by examiner

ENGINE ROTATION CONDITION DETECTING SYSTEM AND ENGINE CONTROL METHOD

CROSS REFERENCE TO RELATED APPLICATION

This application is based on and incorporates herein by reference Japanese patent application No. 2004-253175 filed on Aug. 31, 2004.

FIELD OF THE INVENTION

The present invention relates to an engine rotation condition detecting system and an engine control method, which uses a rotation sensor of an electric driving motor of a variable valve timing apparatus.

BACKGROUND OF THE INVENTION

In engine control systems, as proposed in JP 60-240875, an engine rotation speed is detected based on an interval between pulse signals successively generated by a crank angle sensor during engine rotation.

During engine rotation, cylinders are discriminated based on output signals of a crank angle sensor and a cam angle sensor indicative of crankshaft rotation angles (angular positions) and camshaft rotation angles (angular positions). Ignition timing and fuel injection are also controlled based on those output signals. When an engine is started by a starter, it is not clear to which cylinder fuel and ignition should be supplied first until a specified cylinder is discriminated.

It is therefore proposed to store in a memory a crank angle detected by a crank angle sensor when the engine stops as an engine rotation stop position. This stored crank angle is used as a reference to start ignition control and fuel injection control until a predetermined crank angle of a specified cylinder is detected at the time of next engine starting.

As crank angle sensors for engine control systems, an electromagnetic pick-up type sensor is used. This electromagnetic sensor cannot generate large induction voltages at low engine speed conditions, which may occur right after the engine is started or immediately before the engine is stopped. Therefore, low engine rotation speeds or stop position cannot be accurately detected based on the output signal of the electromagnetic sensor.

Further, although the engine sometimes rotates in reverse immediately before its stop due to compression pressure of the engine in the compression stroke, this reverse rotation cannot be detected from the pulse signal of the electromagnetic sensor. As a result, the pulse signal of the electromagnetic sensor may erroneously represents the engine rotation stop position due to the reverse rotation.

Hall element type sensors may alternatively be used in place of the electromagnetic sensors. The Hall sensors cost more than the electromagnetic sensors.

Recent internal combustion engines have a variable valve timing (VVT) control mechanism, which varies a camshaft rotation angle relative to a crankshaft rotation angle thereby to vary the open/close timing of intake valves and exhaust valves relative to an engine rotation position. This mechanism uses an electric motor as a driving source for the camshaft as proposed in PCT publication WO 2004/038200 A1, which corresponds to U.S. patent application Ser. No. 10/510,765. To accurately control the camshaft rotation, the motor rotation must be controlled accurately in accordance with engine operating conditions. Therefore, a rotation position sensor is also used to detect a rotation position of the motor. A Hall element type sensor or other types of sensors are used as the motor rotation position sensor.

SUMMARY OF THE INVENTION

It is therefore an object of the present invention to provide an engine rotation condition detecting system and an engine control method, which can accurately detect the rotation condition in less cost.

According to the present invention, an internal combustion engine has a variable valve timing control mechanism, in which a camshaft is driven by an electric motor. A motor rotation position sensor, which may be a Hall element type sensor, is provided to detect motor rotation positions. Rotation speeds, rotation directions and/or rotation positions of the internal combustion engine are detected as engine rotation conditions based on output signals of the motor rotation position sensor, when the electric motor is rotated in phase as the camshaft. Thus, the motor rotation sensor is used for detecting both motor rotation and engine rotation. Since the motor rotation sensor detects the motor rotations accurately even at very low speeds, the engine rotation can also be detected accurately even at very low speeds.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

First Embodiment

Figure 1:
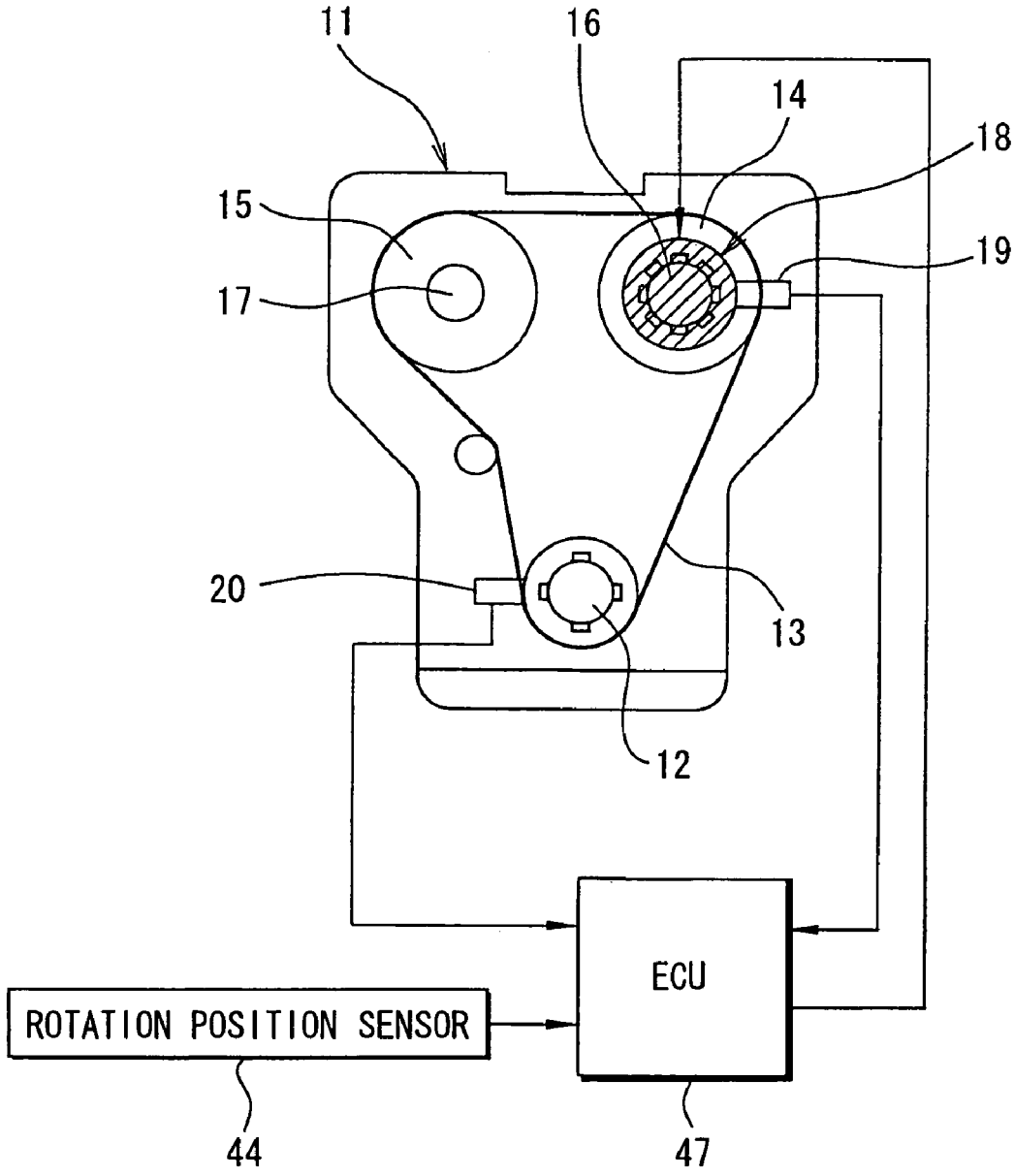
FIG. 1 is a schematic diagram showing an engine system having a variable valve timing apparatus according to embodiments of the present invention.

Referring first to FIG. 1, an internal combustion engine 11 has a crankshaft 12, an intake side camshaft 16 and an exhaust side camshaft 17. The camshafts 16 and 17 are coupled with the crankshaft 12 by a timing chain or belt 13 through respective sprockets 14 and 15 to be driven by the crankshaft 12. A motor-driven variable valve timing (VVT) apparatus 18 is provided on the intake side camshaft 16. The apparatus 18 varies the rotation phase (camshaft phase) of the intake side camshaft 16 relative to the crankshaft 12, so that the valve timing (open/close timing) of an intake valve (not shown) driven by the intake side camshaft 16 is varied.

A cam angle sensor 19 is provided near an outer periphery of the camshaft 16 to generate a cam angle signal at every predetermined cam angle rotation. A crank angle sensor 20 is provided near an outer periphery of the crankshaft 12 to generate a crank angle signal at every predetermined crankshaft angular rotation. The sensors 19 and 20 may be an electromagnetic type. Both sensors 19 and 20 are connected to an electronic control unit (ECU) 47. In addition to the sensors 19 and 20, a motor rotation position sensor 44, which detects a rotation position of a motor of the VVT apparatus 18, is also connected to the ECU 47. Based on those signals and other engine condition signals, the ECU 47 controls fuel injection by a fuel injection device (not shown) and ignition timing by an ignition device (not shown) in the conventional manner and further controls the VVT apparatus 18.

Figure 2:
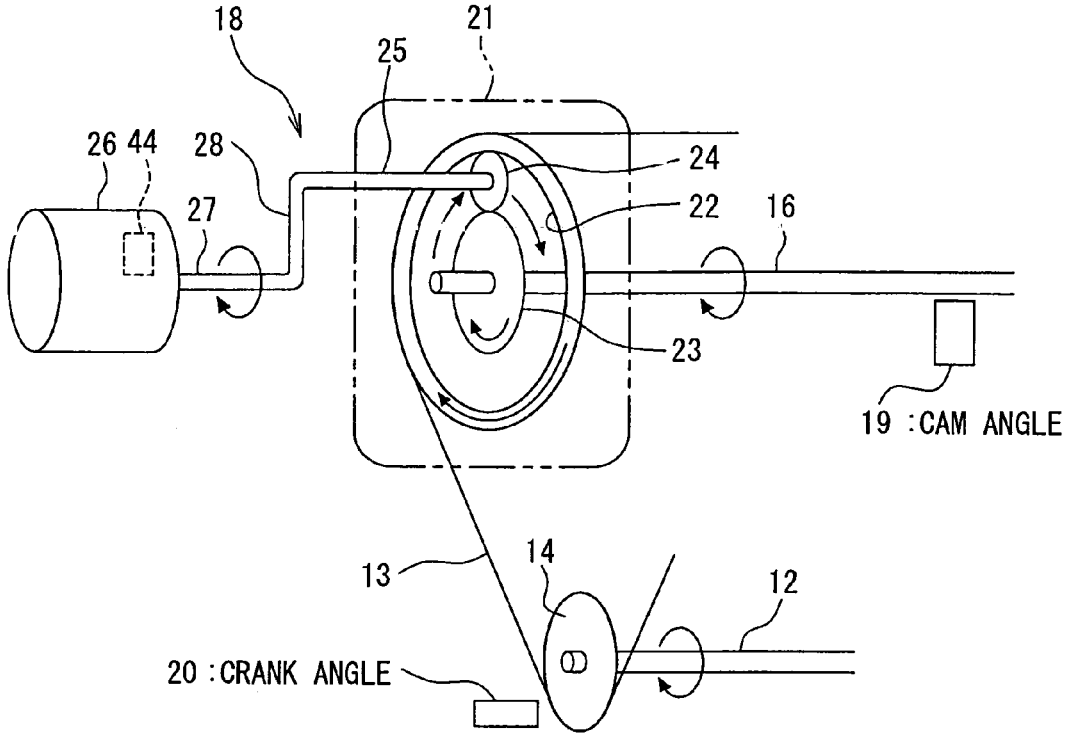
FIG. 2 is a schematic diagram showing the variable valve timing apparatus shown in FIG. 1.

As shown in FIG. 2, the VVT apparatus 18 has a phase varying mechanism 21, which is constructed with an outer gear 22, an inner gear 23 and a planetary gear 24. The outer gear 22 is arranged concentrically with the intake side camshaft 16 and formed with inner teeth (not shown). The inner gear 23 is arranged radially inside and concentrically with the outer gear 22 and formed with outer teeth. The planetary gear 24 is arranged between the gears 22 and 23 and meshed with the inner teeth and the outer teeth of the gears 22 and 23.

The outer gear 22 is coupled with the crankshaft 12 through the timing chain and the sprocket 14 to rotate in synchronism with the crankshaft 12. The inner gear 23 is coupled with the camshaft 16 to rotate in synchronism with the camshaft 16, which normally rotates at a one half speed of the crankshaft 12. The planetary gear 24 revolves around the inner gear 23 while being meshed with the gears 22 and 23. The planetary gear 24 thus transmits the rotating force of the outer gear 22 to the inner gear 23. It also varies the rotation phase (camshaft phase) of the inner gear 23 relative to the outer gear 22 by varying its revolving speed (circumferentially moving speed) relative to the rotation speed of the outer gear 22.

An electric driving motor 26 is provided to drive the planetary gear 24 at variable revolving speeds. A rotation shaft 27 of the driving motor 26 is arranged concentrically with the intake side camshaft 16 and two gears 22 and 23. The rotation shaft 27 and a supporting shaft 25 of the planetary gear 24 are coupled through a connecting shaft 28 extending in the radial direction. Thus, the planetary gear 24 is rotated around the supporting shaft 25 and revolves on the outer circumference of the inner gear 23.

In the VVT apparatus 18, when the driving motor 26 is not in operation, the rotation shaft 27 is rotated in synchronism with the camshaft 16. When the rotation speed RM of the rotation shaft 27 of the driving motor 26 equals the rotation speed RC of the camshaft 16 and the revolving speed of the planetary gear 24 equals the rotation speed of the inner gear 23 (rotation speed of the outer gear 22), the outer gear 22 and the inner gear 23 rotate with the same phase difference. Under this condition, the valve timing of the intake valve (camshaft phase) is maintained unchanged relative to the crankshaft rotation angle.

When the valve timing of the intake valve needs be advanced, the driving motor 26 is driven to rotate at the rotation speed RM higher than the rotation speed of the camshaft 16 thereby to increase the revolving speed of the planetary gear 24 to be faster than that of the inner gear 23. Thus, the rotation phase of the inner gear 23 relative to the outer gear 22 is advanced so that the valve timing is advanced.

When the valve timing of the intake valve needs be retarded, the driving motor 26 is driven to rotate at the rotation speed RM lower than the rotation speed of the crankshaft 12 thereby to decrease the revolving speed of the planetary gear 24 to be slower than that of the inner gear 23. Thus, the rotation phase of the inner gear 23 relative to the outer gear 22 is retarded so that the valve timing is retarded.

Figure 3:
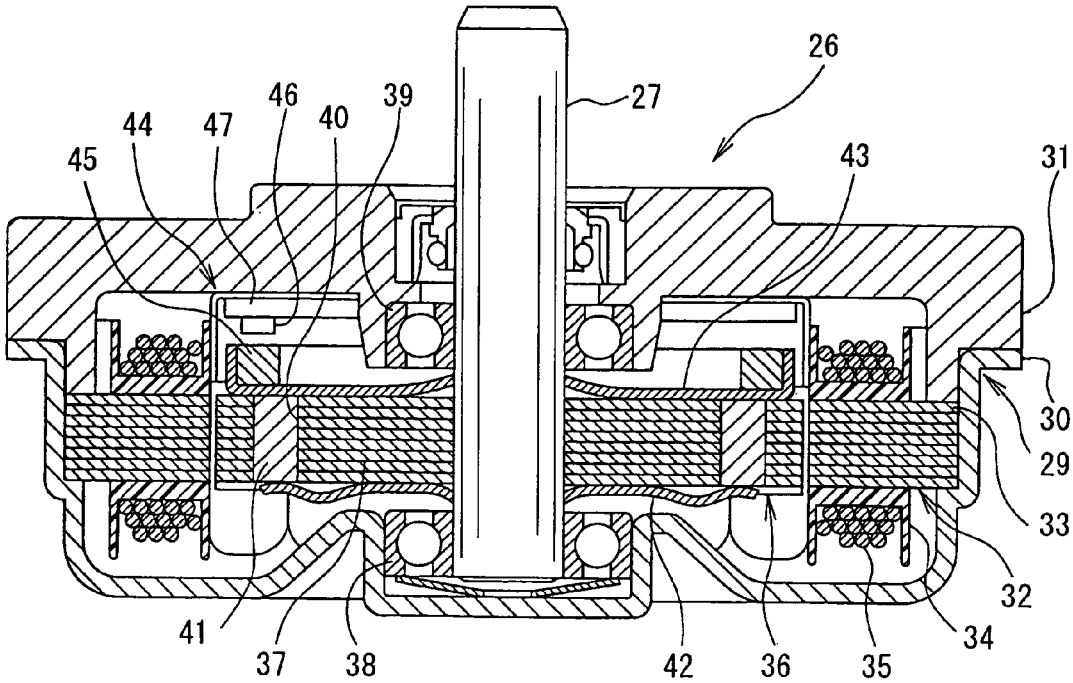
FIG. 3 is a sectional view showing an electric motor used in the variable valve timing apparatus.

The driving motor 26 may be, as shown in FIG. 3, a three-phase brushless motor. A housing 29 of the motor 26 has a bottomed cylindrical casing section 30 and lid section 31, which closes an opening of the casing section 30. A cylindrical stator 32 is fixed to the inner peripheral surface of the hosing 29. In the stator 32, a winding of each phase is wound on a plurality of teeth of a stator core 33 though an insulator 34. A rotor 36 is rotatably supported in the stator 32.

The rotor 36 has a rotor core 37 made of a stack of a plurality of disk-shaped core sheets and has a through hole formed in the center of the rotor core 37. The rotation shaft 27 is fit in the through hole to rotate with the rotor core 37. The rotation shaft 27 is rotatably supported by bearings 38 and 39 fit in the casing section 30 and the lid section 31. The rotor core 37 has a plurality of slit sections 40 arranged at a uniform angular interval in the circumferential direction. A permanent magnet 41 is fit in each slit section 40. Non-magnetic fixing plates 42 and 43 are fit on the rotation shaft 27 at both axial sides of the rotor core 37 to restrict the permanent magnets 41 from disengaging from the slit sections 40.

A motor rotation position sensor 44 is provided in the driving motor 26 to produce a motor rotation position signal at each predetermined angular rotation of the rotor 36. The motor rotation sensor 44 is constructed with a ring-shaped sensor magnet 45 and a Hall element 46 provided to face the sensor magnet 45. The sensor magnet 45 is fixed to the fixing plate 43 to rotate with the rotor 36. The Hall element 46 is fixed to a circuit board 47 attached to the lid section 31. An electronic circuit (not shown) provided on the circuit board 47 sequentially energizes the phase windings 35 in accordance with the rotation position of the rotor 36 detected by the motor rotation position signal to rotate the rotor 36.

The ECU 48 controls the VVT apparatus 18, specifically the driving motor 26, by executing a variable valve timing control program in the conventional manner so that an actual valve operation timing of the intake valve is regulated to a target valve operation timing.

Figure 4:
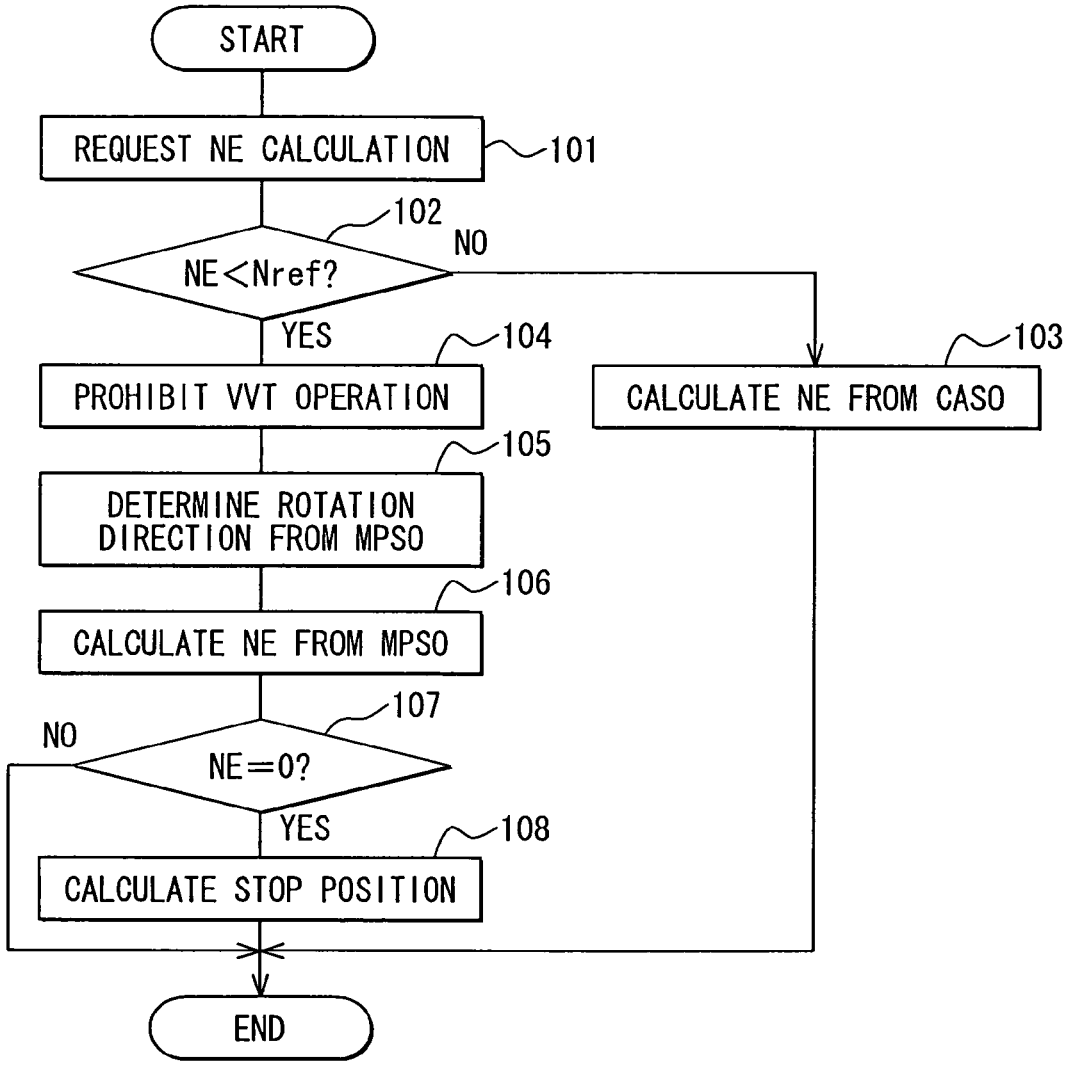
FIG. 4 is a flowchart showing an engine rotation detecting program according to a first embodiment of the present invention.

In addition, the ECU 48 executes an engine rotation condition detecting program shown in FIG. 4 at regular intervals. When the engine rotation speed NE is higher than a predetermined reference speed Nref, the ECU 48 detects an engine rotation speed NE based on the crank angle signal of the crank angle sensor 20. When the engine rotation speed NE is lower than the predetermined reference speed Nref during the engine operation, the ECU 48 detects not only the engine rotation speed NE but also an engine rotation direction based on the motor rotation signal of the motor rotation sensor 44. During the engine stop condition, the ECU 48 detects the engine rotation stop position, that is, rotation stop position of the crankshaft 12 based on the motor rotation signal of the motor rotation sensor 44. For the operation of the ECU 48, electric power is supplied to the ECU 48 not only while an ignition switch (not shown) is kept turned on but also for a certain period after the ignition switch is turned off.

As shown in FIG. 4, the ECU 48 first requests a calculation of the engine rotation speed NE at step 101 and checks whether the rotation speed NE (for instance, previous rotation speed) is lower than the reference speed Nref at step 102. This reference speed Nref is set to a lower limit speed (for instance, about 100 rpm) or a little higher than that, which can be calculated accurately based on the crank angle sensor output signal of the crank angle sensor 20.

If the engine rotation speed NE is determined to be higher than the reference speed Nref, the ECU 48 determines that the rotation speed can be calculated with sufficient accuracy and calculates the rotation speed NE based on the crank angle sensor output signal (CASO) of the crank angle sensor 20 at step 103.

If the engine rotation speed NE is determined to be lower than the reference speed Nref, the ECU 48 determines that the rotation speed cannot be calculated with accuracy and prohibit the operation of the VVT apparatus 18 by stopping the power supply to the driving motor 26 at step 104. Under this condition, the crankshaft 12, the rotation shaft 27 of the driving motor 26 and the camshaft 16 rotates in synchronism with each other. As a result, the rotation condition of the driving motor 26 indicates the rotation condition of the engine 11.

The ECU 48 determines at step 105 the rotating direction of the engine 11 based on the motor rotation position sensor output signal (MPSO) of the motor rotation sensor 44 and the like at step 105. It then calculates at step 106 the rotation speed NE of the engine 11 based on changes in the motor rotation position sensor output signal and the like.

The ECU 48 checks at step 107 whether the calculated engine speed NE is zero, that is, whether the engine 11 is stopped. If the engine is at rest, the ECU 48 calculates at step 108 the engine rotation stop position (crank angle) based on the motor rotation position sensor output signal (MPSO) produced when the engine 11 is stopped.

According to the above embodiments, the motor rotation sensor 44 is provided in the driving motor 26, and the rotation speed NE and the rotation direction of the engine 11 are detected based on the output signal of the motor rotation sensor 44 when the power supply to the driving motor 26 is stopped. The motor rotation sensor 44 is constructed with the magnet 45 and the Hall element 46 and hence produce the output signal accurately even under the very low rotation condition. Therefore, the rotation speed NE and the rotation direction can be detected accurately. The motor rotation sensor 44 is used to detect the rotation speed NE of the engine 11 at low speed condition. Therefore, no additional rotation sensor need not be provided for detecting low engine speeds.

As the rotation speed NE (frequency of the output signal of the motor rotation sensor 44) increases, the ECU 48 needs to calculate the rotation speed NE more frequently. However, the output signal (MPSO) of the motor rotation sensor 44 is used to calculate the rotation speed NE only when the output signal (CASO) of the crank angle sensor 20 cannot be reliably used. Therefore, the ECU 48 is relieved from heavy load of calculating the rotation speed NE from the output signal (MPSO) of the motor rotation sensor 44.

The motor rotation sensor 44 is constructed to produce the output signal even when the driving motor 26 is not operating. Therefore, the engine stop position can be detected accurately without being influenced by a reverse rotation of the engine, which may occur immediately before the engine 11 stops.

Second Embodiment

In the second embodiment, the ECU 48 detects the engine rotation speed NE and the engine rotation direction based on the output signal (MPSO) of the motor rotation sensor 44 by controlling the rotation phase of the camshaft 16 to the most retarded or advanced position relative to the rotation phase of the crankshaft 12, when the rotation speed NE is low. The ECU 48 further detects the engine rotation stop position based on the output signal (MPSO) of the motor rotation sensor 44 when the engine 11 is stopped with the camshaft rotation phase being held controlled to the most retarded or advanced position.

Figure 5:
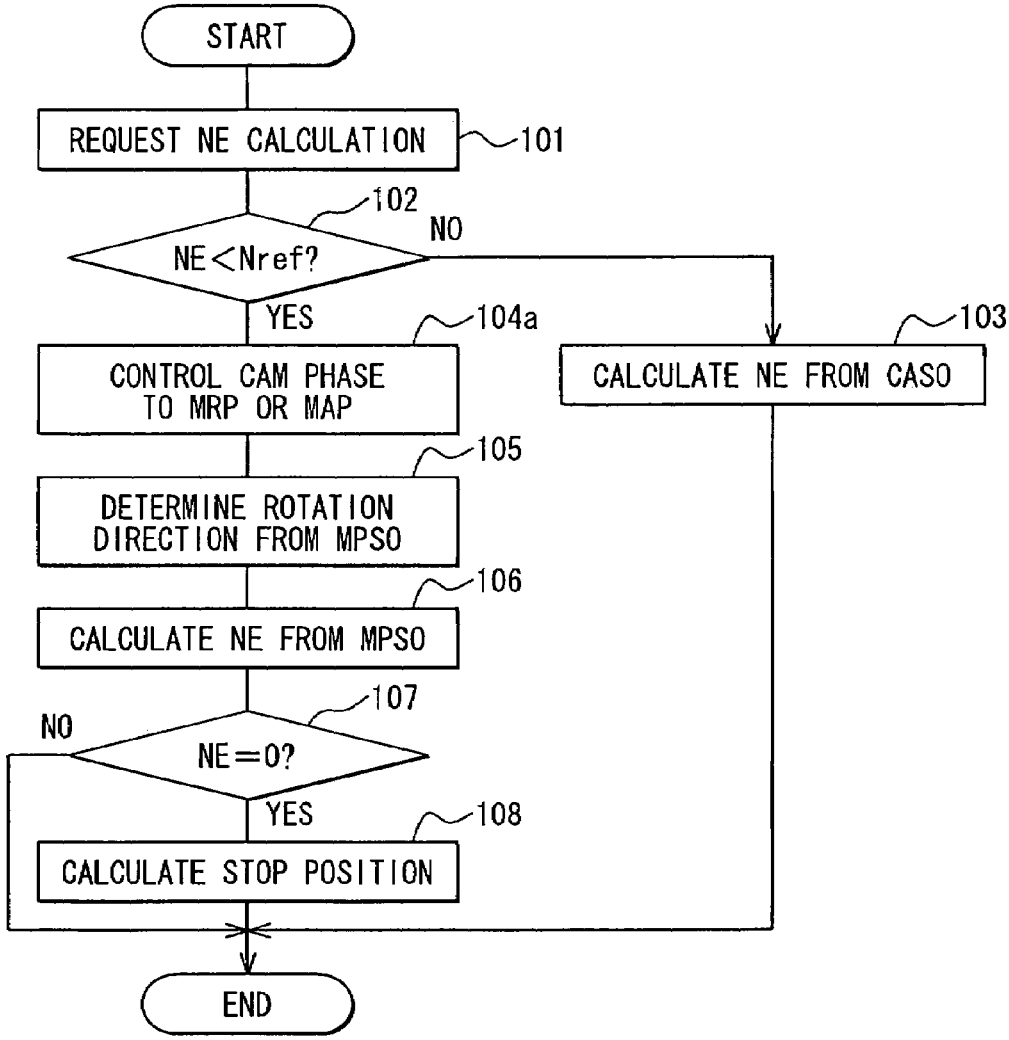
FIG. 5 is a flowchart showing an engine rotation detecting program according to a second embodiment of the present invention.

Specifically, as shown in FIG. 5, the ECU 48 controls the camshaft rotation phase to the most retarded position (MRP) or most advanced position (MAP) at step 104a when the engine rotation speed NE is determined to be lower than the reference speed (Nref) at step 102. In this instance, the driving motor 26 is driven to move a movable part (not shown) of the VVT apparatus 18 to a stopper (not shown), which defines the most retarded or advanced position.

Thus the rotation speeds of the driving motor 26 and the camshaft 16 are made equal to each other, and the rotation phases of the rotation shaft 27 and the camshaft 14 are also made equal to each other. Under this condition, the engine rotation direction, the engine rotation speed NE and the engine rotation stop position are calculated at steps 105 to 108 based on the output signal (MPSO) of the motor rotation sensor 44 without using the output signal of the crank angle sensor 20 in the same manner as in the first embodiment (FIG. 4).

In the above embodiments, the engine rotation speed NE may be calculated based on the output signal (MPSO) of the motor rotation sensor 44 not only when the engine rotation speed NE is lower than the reference speed Nref but also when it is higher than the reference speed Nref. Further, the output signal (MPSO) of the motor rotation sensor 44 may be used in place of the output signal of the crank angle sensor 20 when the crank angle sensor 20 fails.

The VVT apparatus 18 is not limited to the intake valves but may be used for the exhaust valves. The VVT apparatus 18 may use any devices other than the planetary gear 24, as long as the driving motor 26 is capable of varying the rotation phase relation between the crankshaft 12 and the camshaft 16.

Further modifications and alterations are also possible to the above embodiments without departing from the spirit of the present invention.

What is claimed is:

1. A rotation condition detecting system for an internal combustion engine having a crankshaft, a camshaft for opening and closing an intake valve or an exhaust valve, and a variable valve timing apparatus including an electric driving motor coupled with the crankshaft and the camshaft for maintaining a rotation phase of the camshaft relative the crankshaft unchanged when rotated synchronously with the camshaft and varying the rotation phase of the camshaft when rotated asynchronously with the camshaft, the system comprising:

a motor rotation position sensor for producing a motor rotation position signal corresponding to a rotation position of the driving motor; and a stop position detection means for detecting a rotation stop position of the internal combustion engine based on the motor rotation position signal when the internal combustion engine is stopped.

2. The rotation condition detecting system as in claim 1, wherein the rotation detection means detects the rotation stop position under a condition that the internal combustion engine is stopped with the camshaft phase being maintained at either one of a most retarded or advanced rotation position.

3. A rotation condition detecting system for an internal combustion engine having a crankshaft, a camshaft for opening and closing an intake valve or an exhaust valve, and a variable valve timing apparatus including an electric driving motor coupled with the crankshaft and the camshaft for maintaining a rotation phase of the camshaft relative the crankshaft unchanged when rotated synchronously with the camshaft and varying the rotation phase of the camshaft when rotated asynchronously with the camshaft, the system comprising:

a motor rotation position sensor which produces a motor rotation position signal corresponding to a rotation position of the driving motor; and a rotation detector which detects a rotation speed and/or a rotation direction of the internal combustion engine based on the motor rotation position signal when the driving motor is rotated synchronously with the camshaft as a result of the variable valve timing apparatus not being in operation.

4. A rotation condition detecting system for an internal combustion engine having a crankshaft, a camshaft for opening and closing an intake valve or an exhaust valve, and a variable valve timing apparatus including an electric driving motor coupled with the crankshaft and the camshaft for maintaining a rotation phase of the camshaft relative the crankshaft unchanged when rotated synchronously with the camshaft and varying the rotation phase of the camshaft when rotated asynchronously with the camshaft, the system comprising:

a motor rotation position sensor which produces a motor rotation position signal corresponding to a rotation position of the driving motor; and a stop position detector which detects a rotation stop position of the internal combustion engine based on the motor rotation position signal when the internal combustion engine is stopped.

5. A rotation condition detecting system for an internal combustion engine having a crankshaft, a camshaft for opening and closing an intake valve or an exhaust valve, and a variable valve timing apparatus including an electric driving motor coupled with the crankshaft and the camshaft for maintaining a rotation phase of the camshaft relative the crankshaft unchanged when rotated synchronously with the camshaft and varying the rotation phase of the camshaft when rotated asynchronously with the camshaft, the system comprising:

a motor rotation position sensor which produces a motor rotation position signal corresponding to a rotation position of the driving motor; and a rotation detector which detects both a rotation speed and a rotation direction of the internal combustion engine based on the motor rotation position signal when the driving motor is rotated synchronously with the camshaft as a result of the variable valve timing apparatus not being in operation.

* * * * *